US005611662A

United States Patent [19]

Cunha

[11] Patent Number: 5,611,662

[45] Date of Patent: Mar. 18, 1997

[54] IMPINGEMENT COOLING FOR TURBINE STATOR VANE TRAILING EDGE

[75] Inventor: Francisco J. Cunha, Schenectady, N.Y.

[73] Assignee: General Electric Co., Schenectady, N.Y.

[21] Appl. No.: 509,918

[22] Filed: Aug. 1, 1995

[51] Int. Cl.[6] ..... F04D 29/38

[52] U.S. Cl. ..... 415/115; 416/97 R

[58] Field of Search ..... 415/115, 116; 416/97 R

[56] References Cited

U.S. PATENT DOCUMENTS

| | | | |
|---|---|---|---|
| 3,301,527 | 1/1967 | Kercher | 416/97 |
| 3,844,679 | 10/1974 | Grondahl et al. | 416/97 |
| 3,849,025 | 11/1974 | Grondahl | 416/97 |
| 5,052,889 | 10/1991 | Abdel-Messeh | 416/97 |
| 5,253,976 | 10/1993 | Cuhna . | |
| 5,320,483 | 6/1994 | Cunha et al. . | |
| 5,340,274 | 8/1994 | Cuhna . | |

FOREIGN PATENT DOCUMENTS

| | | | |
|---|---|---|---|
| 192804 | 10/1985 | Japan | 416/97 |

*Primary Examiner*—John T. Kwon
*Attorney, Agent, or Firm*—Nixon & Vanderhye

[57] ABSTRACT

A cooling air circuit for the trailing edge cavity of a nozzle segment for a gas turbine includes a plurality of cooling sections radially spaced one from the other along the vane. Air flows radially inwardly and is turned by guide vanes for axial flow for impingement cooling of the trailing edge. The flow is such that vortices are formed and heat is carried away from the trailing edge by cooling flow directed forwardly from the trailing edge through another series of guide vanes. The rearward and forward sequential flows are provided in repeated patterns at radially spaced positions along the trailing edge until finally the cooling air flows through a trailing edge cavity outlet into a diaphragm. The diaphragm has channels for directing the cooling flow from the diaphragm at an angle into the wheelspace for cooling the seal cavity.

16 Claims, 4 Drawing Sheets

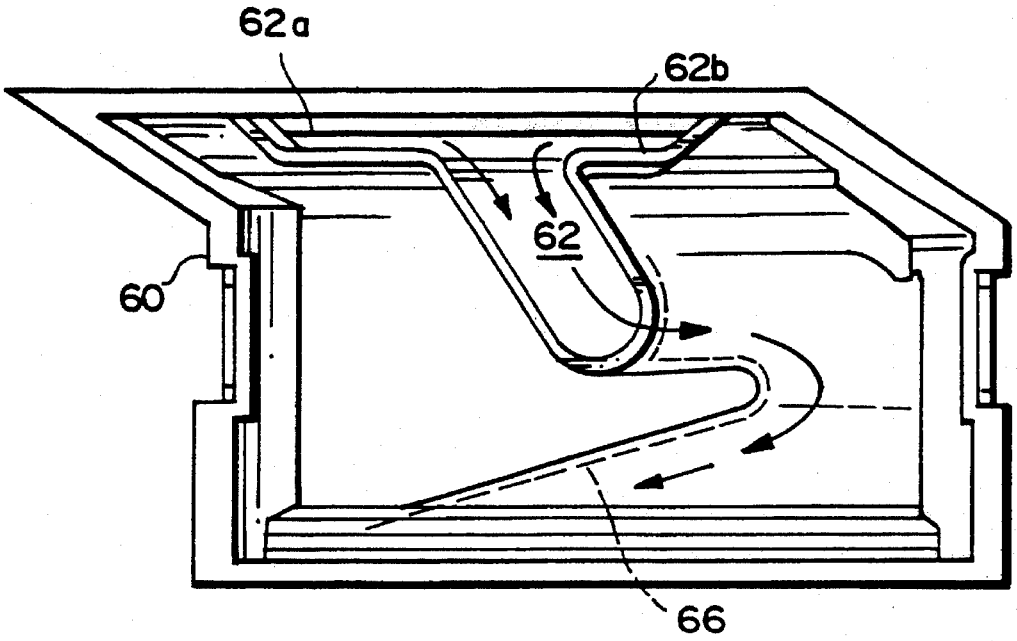
Fig. 5
Fig. 6
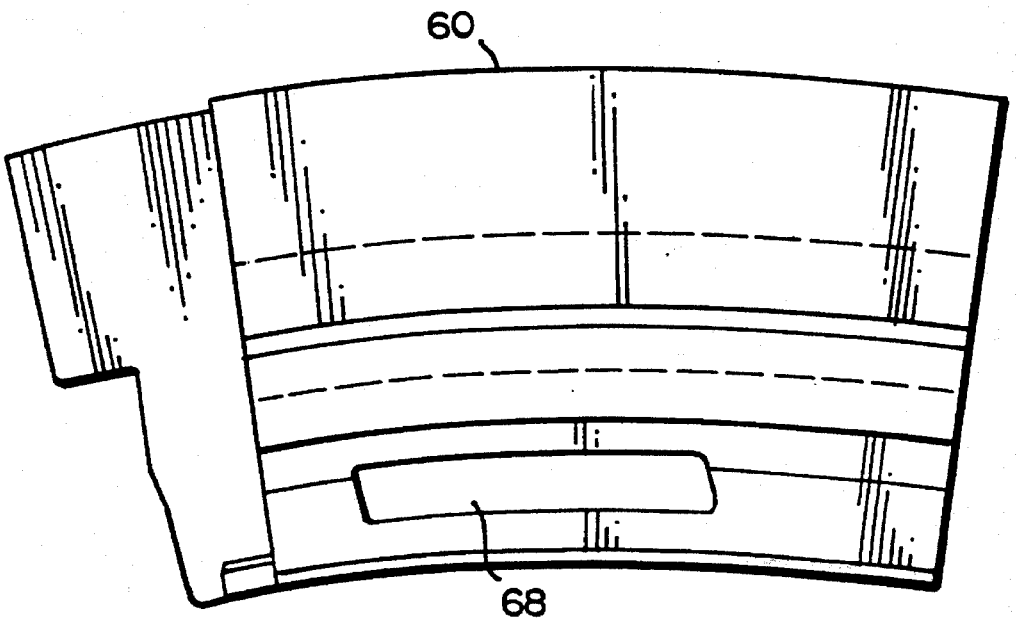

IMPINGEMENT COOLING FOR TURBINE STATOR VANE TRAILING EDGE

TECHNICAL FIELD

The present invention relates generally to land-based gas turbines, for example, for electrical power generation, and particularly to a cooling circuit for the trailing edge cavity of a nozzle stage of the turbine.

BACKGROUND

The traditional approach for cooling turbine blades and nozzles is to extract high pressure cooling air from a source, for example, by extracting air from the intermediate and last stages of the turbine compressor. External piping is used to supply air to the nozzles with air film cooling typically being used, the air exiting into the hot gas stream of the turbine. In advanced gas turbine designs, it has been recognized that the temperature of the hot gas flowing past the turbine components could be higher than the melting temperature of the metal. It is therefore necessary to establish a cooling scheme to protect the hot gas path components during operation. Steam supplied in a closed circuit to cool gas turbine nozzles (stator vanes) has been demonstrated to be a preferred cooling medium, particularly for combined cycle plants. See, for example, U.S. Pat. No. 5,253,976, of common assignee herewith. Because steam has a higher heat capacity than the combustion gas, it is inefficient to allow the coolant steam to mix with the hot gas stream. Consequently, it is desirable to maintain cooling steam inside the hot gas path components in a closed circuit. It has been found, however, that certain areas of the components of the hot gas path cannot practically be cooled with steam in a closed circuit. For example, the relatively thin structure of the trailing edges of the nozzle vanes effectively precludes steam cooling of those edges.

DISCLOSURE OF THE INVENTION

For purposes of this discussion, the air cooling circuit for the stator nozzle of this invention constitutes one aspect of a novel and improved turbine which is the subject of a number of co-pending patent applications, certain of which are listed below. In that turbine, preferably four stages are provided, with an inner shell mounting the first and second stage nozzles, as well as the first and second stage shrouds, while an outer shell mounts the third and fourth stage nozzles and shrouds. Such turbine is designed for conversion between air and steam cooling of the rotational and stationary components. In a closed circuit steam cooling system for the above-noted turbine, closed circuit steam cooling supply and spent cooling steam return conduits, as well as closed circuit steam cooling conduits for the turbine rotor for delivery of the cooling steam to the buckets of the first and second stages, as well as to the rotor wheel cavities and the rotor rim are provided. Where an air cooled turbine is necessary, cooling air may be supplied to the stationary components, e.g., the first and second stage nozzles, as part of high pressure discharge air from the compressor. The cooling air may be supplied in an open circuit exiting the partitions or vanes of the first and second stage nozzles for film cooling into the hot gas stream. Cooling air may similarly be piped directly through the outer shell to the third stage nozzle while the fourth stage nozzle remains uncooled. Open air cooled circuits are also provided for the rotational components of the turbine, i.e., the buckets, in a conventional manner.

The present invention addresses the provision of an air cooling circuit for the trailing edge cavity of a stator vane preferably used in conjunction with the steam cooling of leading edge and one or more intermediate cavities but which can be used in a total air cooling system for a nozzle stage. Preferably, film cooling by exiting the cooling air from the trailing edge cavity is omitted in favor of closed air cooling for the trailing edge cavity to prevent film cooling while maintaining high cooling effect for the trailing edge.

To summarize the state of development of this new turbine, the use of inner and outer shells to support stationary components of the turbine which can be converted between air and steam cooling is described and illustrated in co-pending patent application Ser. No. 08/414,698, entitled "Removable Inner Turbine Shell with Bucket Tip Clearance Control" (Attorney Docket No. 839-346), the disclosure of which is incorporated herein by reference. For a complete description of the steam cooled buckets, reference is made to companion co-pending allowed application Ser. No. 08/414,700, entitled "Closed Circuit Steam Cooled Bucket" (Attorney Docket No. 839-352), the disclosure of which is incorporated herein by reference. Air cooled buckets, per se, are well known in the art. For a complete description of the steam (or air) cooling circuit for supplying cooling medium to the first and second stage buckets through the rotor, reference is made to co-pending patent application Ser. No. 08/414,695, entitled "Closed or Open Circuit Cooling of Turbine Rotor Components" (Attorney Docket No. 839-358). For a complete description of the steam cooled nozzles with air cooling along the trailing edge, reference is made to companion co-pending application Ser. No. 08/414,697, entitled "Turbine Stator Vane Segments having Combined Air and Steam Cooling Circuits" (Attorney Docket No. 839-354), the disclosure of which is incorporated herein by reference. For a description of an open or closed air cooling circuit, reference is made to companion co-pending application Ser. No. 08/509,917, entitled "Closed or Open Air Cooling Circuits for Nozzle Segments with Wheelspace Purge," (Attorney Docket No. 839-351), the disclosure of which is incorporated herein by reference. The present invention therefore addresses the air cooling circuit for the trailing edge of a stator vane, particularly a second-stage nozzle vane for that turbine when the turbine is provided as a steam cooled turbine with steam coolant flows through cavities in the nozzle vanes forwardly of the trailing edge cavity, although it will be appreciated that an all air cooled nozzle vane may be used in conjunction with the present invention.

In accordance with the present invention, there is provided an air cooling system for cooling the trailing edge of the hot gas components of a nozzle stage of a gas turbine, for example, the second nozzle stage, in which closed circuit steam cooling is employed for cooling the nozzle, although all air cooling of the nozzle may be utilized. In the trailing edge cavity of the stator vane according to the present invention, a first guide vane is located at the cooling air inlet at a radially outermost position of the vane. The first guide vane is disposed between the convergent walls of the trailing edge cavity, leaving openings between the axially opposite ends of the guide vane and the walls of the cavity. The forward opening provides the majority of the flow of air into the trailing edge cavity, while the rear or aft opening provides a bypass flow which prevents flow stagnation areas radially inwardly of the first guide vane. As the cooling flow proceeds radially inwardly into the trailing edge cavity, a second guide vane disposed radially inwardly of the first guide vane blocks the majority of the radially inwardly directed flow passing through the forward opening of the first guide vane. The second guide vane is disposed between the opposite convergent walls of the trailing edge cavity and its opposite ends define with the opposite end walls of the cavity a forward bypass flow opening and a rearward opening for passing the majority of the cooling flow. A third guide vane is disposed radially inwardly of the second guide vane and is likewise disposed between opposite convergent walls of the trailing edge cavity. The opposite ends of the third guide vane define with the end walls a forward opening for flowing a majority of cooling flow and a rearward bypass opening.

Intermediate the first and second guide vanes are one or more radially spaced intermediate guide vanes. These intermediate guide vanes extend between opposite convergent walls of the trailing edge cavity, the lengths of the intermediate guide vanes being considerably shorter than the lengths of the first, second and third guide vanes. Also, the intermediate guide vanes are staggered in a radially inward forward direction.

The flow pattern from the inlet caused by the arrangement of these guide vanes prevents the cooling flow from flowing directly radially inwardly and directs the flow in an axial direction toward the trailing edge for impingement against the end wall of the cavity defining the trailing edge. Thus, the flow of cooling air turned from a radially inward direction to an axially rearward direction by the arrangement of the guide vanes causes impingement cooling of the trailing edge. The flow exhibits a boundary layer character near the convergent walls which remains nearly constant over a large center portion of the flow. As the flow approaches the apex of the trailing edge cavity, a series of vortices occurs in the flow which remove heat from the region of the trailing edge cavity adjacent the trailing edge by returning the flow in a forward and radial inward direction. The momentum associated with the incoming flows forces the returning flow to flow radially inwardly rather than to proceed upstream.

The flow converges through an opening through the trailing edge of the second guide vane and a mid-portion of the third guide vane for flow between those guide vanes and through the forward opening defined by the third guide vane into a lower section. Upon return of the spent impingement cooling medium between the second and third guide vanes, the flow is mixed with the bypass flow passing through the forward opening of the second guide vane.

A plurality of sections having similar guide vanes and locations thereof serve to continuously direct the flow axially rearwardly for impingement cooling of the trailing edge and forwardly and radially inwardly for flow to another section. The cooling medium flows radially inwardly through an outlet at the radial inner end of the stator vane into a chamber in the diaphragm of the stator vane.

The nozzle stages for the turbine including the diaphragm are formed of segments arranged to form an annulus. Each segment is designed to accommodate two stator vanes and hence the outlet of each vane lies in communication with an inlet of the associated diaphragm segment. These inlets form a common collection chamber for the spent trailing edge impingement cooling flow. The spent flow is turned in the diaphragm so that the flow discharges through an opening at the diaphragm at an angle of approximately 15°. The angle is selected such that the potential for windage losses is minimized in the seal cavity by directing the exit flow tangentially in the same direction as the tangential velocity vector of the rotating turbine wheel in the seal cavity.

In a preferred embodiment according to the present invention, there is provided a stator vane of a nozzle for a turbine comprising an airfoil-shaped stator vane body having a plurality of generally radially extending internal cavities for flowing a cooling medium and including a cavity along a trailing edge of the vane body defined in part by opposed vane walls converging toward one another in an axial direction toward the trailing edge, a radially outer inlet to the trailing edge cavity and a radially inner outlet therefrom for flowing a cooling medium through the trailing edge cavity, a first guide vane in the cavity between opposed walls thereof and defining radially inwardly directed forward and aft openings between opposite ends of the guide vane and end walls of the trailing edge cavity, respectively, a second guide vane in the cavity between opposed walls thereof defining radially inwardly directed forward and aft openings between opposite ends of the second guide vane and end walls of the trailing edge cavity, respectively, and lying radially inwardly of the first guide vane to prevent a majority of flow of cooling medium passing through the forward opening of the first guide vane from passing directly radially inwardly past the second guide vane, a third guide vane in the cavity between opposed walls thereof defining radially inwardly directed forward and aft openings between opposite ends of the third guide vane and end walls of the cavity, respectively, and lying radially inwardly of the second guide vane at a location to prevent the majority of flow of cooling medium passing through the aft opening of the second guide vane from passing directly radially inwardly past the third guide vane and at least one guide vane radially intermediate the first and second guide vanes for directing flow of cooling medium towards the trailing edge along a convergent path for cooling the trailing edge, the second and third guide vanes being located for receiving spent cooling medium for mixing with bypass flow through the forward opening of the second guide vane and combined flow through the forward opening of the third guide vane and for flow through the aft opening of the third guide vane, whereby the cooling medium flow is directed toward the trailing edge for impingement cooling thereof and away from the trailing edge as the cooling medium flows from the inlet to the outlet.

In a further preferred embodiment according to the present invention, there is provided a stator vane of a nozzle for a turbine comprising an airfoil-shaped stator vane body having a plurality of generally radially extending internal cavities for flowing a cooling medium and including a cavity along a trailing edge of the vane body defined in part by opposed vane walls converging toward one another in an axial direction toward the trailing edge, a radially outer inlet to the trailing edge cavity and a radially inner outlet therefrom for flowing a cooling medium through the trailing edge cavity, a plurality of cooling sections spaced radially one from the other along the trailing edge cavity, a first cooling section including (i) a first guide vane in the cavity between opposed walls thereof and defining radially inwardly directed forward and aft openings between opposite ends of the guide vane and end walls of the trailing edge cavity, respectively, (ii) a second guide vane in the cavity between opposed walls thereof defining radially inwardly directed forward and aft openings between opposite ends of the second guide vane and end walls of the trailing edge cavity, respectively, and lying radially inwardly of the first guide vane to prevent a majority of flow of cooling medium passing through the forward opening of the first guide vane from passing directly radially inwardly past the second guide vane, (iii) a third guide vane in the cavity between opposed walls thereof defining radially inwardly directed forward and aft openings between opposite ends of the third guide vane and end walls of the cavity, respectively, and lying radially inwardly of the second guide vane at a location to prevent the majority of flow of cooling medium passing through the aft opening of the second guide vane from passing directly radially inwardly past the third guide vane and (iv) at least one guide vane radially intermediate the first and second guide vanes for directing flow of cooling medium towards the trailing edge along a convergent path for cooling the trailing edge and (v) the second and third guide vanes being located for receiving spent cooling medium therebetween for mixing with bypass flow through the forward opening of the second guide vane and combined flow through the forward opening of the third guide vane and for flow through the aft opening of the third guide vane, a second cooling section radially inwardly of the first section including a second guide vane in the cavity between opposed walls thereof defining radially inwardly directed forward and aft openings between opposite ends of the guide vane of the second section and end walls of the trailing edge cavity, respectively, and lying radially inwardly of the third guide vane of the first section to prevent a majority of the combined flow of cooling medium passing through the forward openings of the second and third guide vanes of the first section from passing directly radially inwardly past the second guide vane of the second section, a third guide vane in the second section of the cavity between opposed walls thereof defining radially inwardly directed forward and aft openings between opposite ends thereof and end walls of the cavity, respectively, and lying radially inwardly of the second guide vane of the second section at a location to prevent the majority of flow of cooling medium passing through the aft opening of the second guide vane of the second section from passing directly radially inwardly past the third guide vane of the second section and at least one guide vane radially intermediate the first and second guide vanes of the second section for directing flow of cooling medium towards the trailing edge along a convergent path for cooling the trailing edge and the second and third guide vanes of the second section being located for receiving spent cooling medium for mixing with bypass flow through the forward opening of the second guide vane of the second section and combined flow through the forward opening of the third guide vane of the second section and for flow through the aft opening of the third guide vane of the second section, whereby the cooling medium flow is repetitively directed toward the trailing edge for impingement cooling thereof and away from the trailing edge as the cooling medium flows from the inlet to the outlet, In a still further preferred embodiment according to the present invention, there is provided a stator vane of a nozzle for a turbine comprising an airfoil-shaped stator vane body having a plurality of generally radially extending internal cavities for flowing a cooling medium and including a cavity along a trailing edge of the vane body defined in part by opposed vane walls converging toward one another in an axial direction toward the trailing edge, a radially outer inlet to the trailing edge cavity and a radially inner outlet therefrom for flowing a cooling medium through the trailing edge cavity in a generally radially inward direction, a plurality of cooling sections spaced radially one from the other along the trailing edge cavity, each cooling section including a plurality of vanes, at least one vane in each section disposed to turn cooling medium flowing in a generally radial direction in a generally axial direction for flow toward the trailing edge and providing impingement cooling thereof, at least another vane in each the section for guiding spent impingement cooling medium from the trailing edge in a direction generally away from the trailing edge and toward forward portions of the trailing edge cavity, whereby cooling medium flow is repeatedly directed toward the trailing edge for impingement cooling thereof and away from the trailing edge as the cooling medium flows radially inwardly from the inlet to the outlet.

Accordingly, it is a primary object of the present invention to provide a novel and improved air cooling circuit for the trailing edge of a stator vane for a gas turbine.

BRIEF DESCRIPTION OF THE DRAWINGS

FIG. 5 is a top plan view of the diaphragm with its cover off; and

FIG. 6 is an end or axial elevational view of the diaphragm.

BEST MODE FOR CARRYING OUT THE INVENTION

Figure 2:
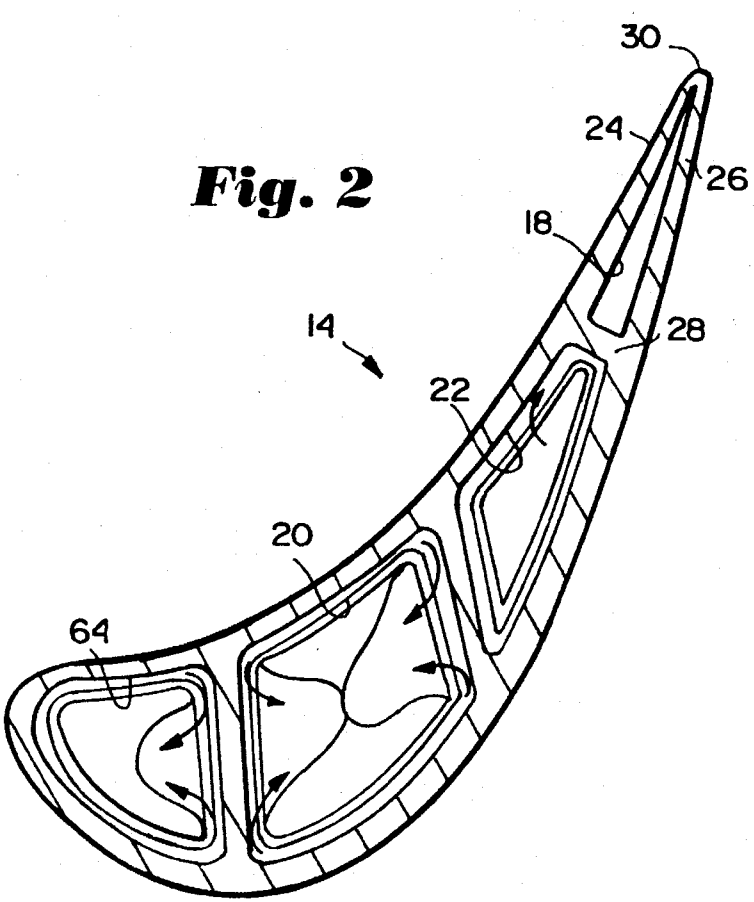
FIG. 2 is an enlarged cross-sectional view of the vane.
Figure 1:
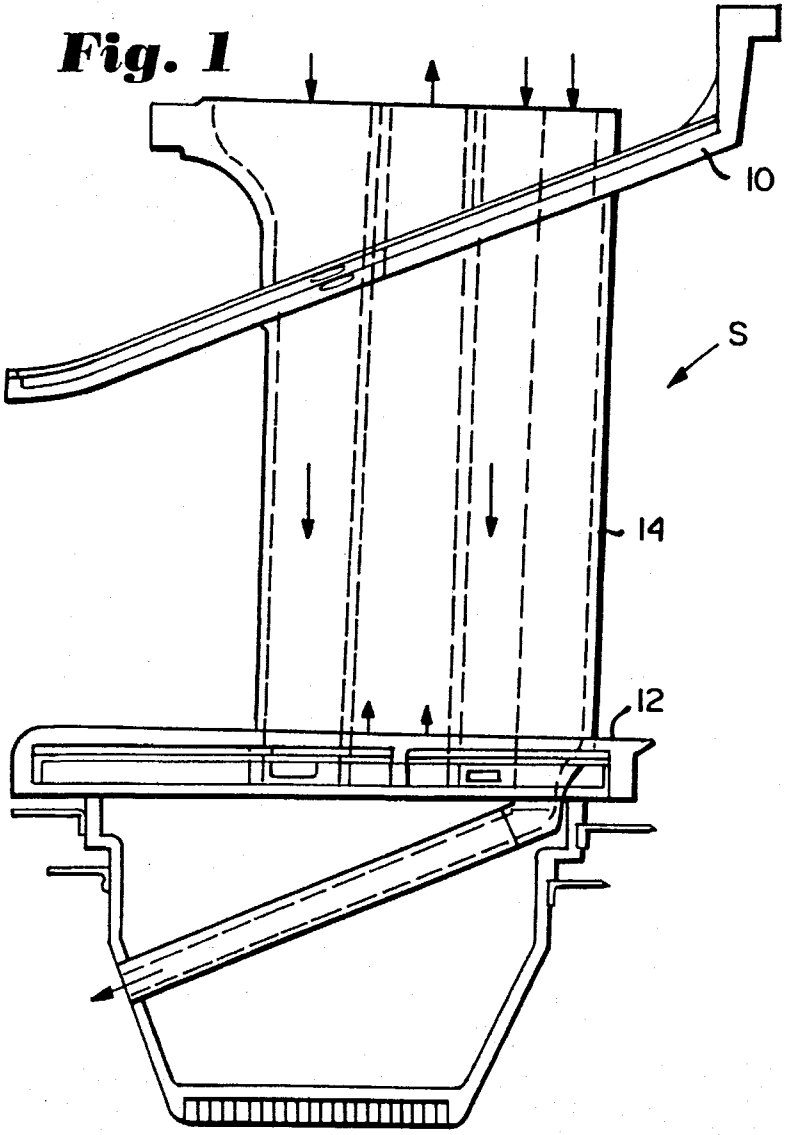
FIG. 1 is a side elevational view of a segment of a nozzle stator vane illustrating a vane between outer and inner walls and a diaphragm.

Referring now to FIGS. 1 and 2, there is illustrated a nozzle vane segment S having a cooling system for the outer and inner walls 10 and 12, respectively, and a stator vane 14 extending therebetween. Preferably, two vanes are provided each segment, although one or three or more vanes may likewise be provided each segment. The outer and inner walls 10 and 12 have various chambers and impingement plates for impingement cooling thereof, while the vane has a plurality of radially extending cavities, for example, a leading edge cavity 16, a trailing edge cavity 18 and intermediate cavities 20 and 22. The cavities provide cooling circuits for the vane and the walls. For a detailed description of the cooling circuits, for example, where steam cooling is utilized in cooling the cavities 16, 20 and 22, reference is made to pending prior application Ser. No. 08/414,697 (Attorney Docket No. 839-354), the disclosure of which is incorporated herein by reference. For air cooling these cavities, reference is made to pending U.S. patent application Ser. No. 08/509,917 (Attorney Docket No. 839-351), the disclosure of which is incorporated herein by reference. The present invention refers only to the air cooling of the trailing edge cavity 18 and the wheelspace defined by the diaphragm of the nozzle segment S. Suffice to say that the cavities 16, 20 and 22 may be impingement steam cooled in the manner set forth in the first-mentioned prior application in a closed circuit system, or open or closed circuit air cooling may be utilized as in the cooling system disclosed in the second mentioned application.

Referring now to FIG. 2, the trailing edge cavity 18 has convergent side walls 24 and 26 terminating at opposite end walls 28 and 30. It will be appreciated that the wall 28 forms the rib between the trailing edge cavity 18 and the next forward intermediate cavity 22. The wall 30 forms the trailing edge of the vane 14.

Figure 3:
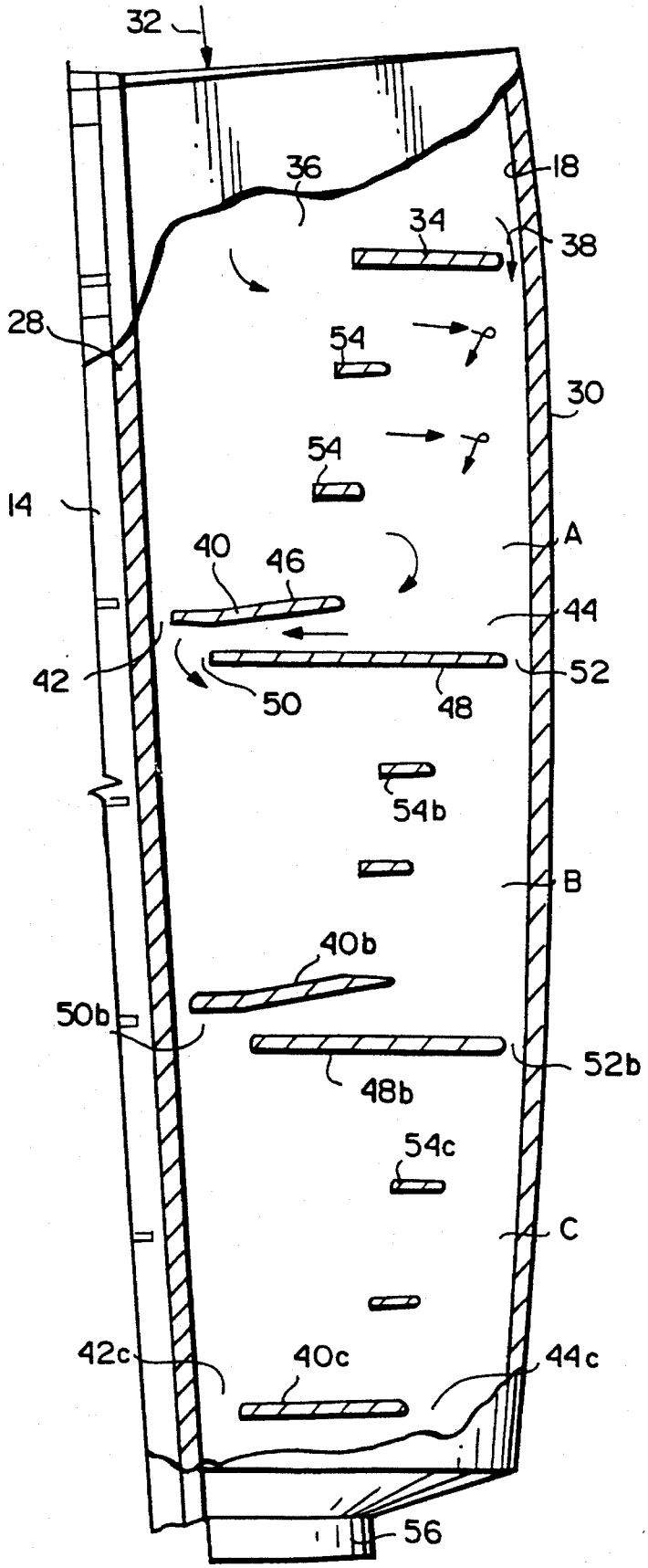
FIG. 3 is an enlarged cross-sectional view of the trailing edge cavity of the vane.

The cavity 18 is supplied with air extracted from the turbine compressor, not shown, and which air is supplied through an inlet schematically illustrated in FIG. 3 at 32 to the cavity 18. The cavity is essentially divided as illustrated in FIG. 3 into three radially spaced sections, although it will be appreciated that fewer or additional sections may be provided and that in each section, the flow pattern is essentially the same. In the first section, there is provided a first guide vane 34 which extends between the opposite converging walls 24 and 26 defining the cavity 18 and lies short of the end walls 28 and 30. The first guide vane 34 is located axially in the cavity such that a substantial opening for receiving the radially inwardly directed flow of cooling air is provided between the forward end of guide vane 34 and the wall 28 as indicated at 36. In contrast, the rear or aft end of guide vane 34 is spaced from the trailing edge end wall 30 by a small opening 38 affording bypass flow of cooling medium, i.e., air, in the direction of the arrow.

A second guide vane 40 is provided radially inwardly of the first guide vane 34. The second guide vane 40 extends between the opposite converging walls 24 and 26 of cavity 18 and is located axially forwardly in cavity 18. Thus, the forward end of second guide vane 40 defines with the forward end wall 28 a bypass opening 42 for flowing cooling medium directly radially inwardly past second guide vane 40. The aft or rear end of second guide vane 40 is spaced axially from the rear trailing edge end wall 30 to define an enlarged opening for receiving the flow from radially outermost portions of the trailing edge cavity through section 44. Additionally, the second guide vane 40 includes a portion 46 angled in a radially outward direction from front to rear as illustrated.

A third guide vane 48 is disposed at a location radially inwardly of the first and second guide vanes 34 and 40, respectively, and extends between the convergent walls 24 and 26 of the trailing edge cavity. The forward end of guide vane 48 defines with the forward wall 28 a flow opening 50 for flowing the majority of the cooling medium from locations radially outwardly of the third guide vane 48 in a direction radially inwardly to the next cooling section. The rear or aft end of the third guide vane 48 is spaced from the trailing edge end wall 30 to define a bypass opening 52.

Between the first and second guide vanes 34 and 40, respectively, there are provided one or more intermediate guide vanes 54 which likewise extend between the convergent walls 24 and 26 of the trailing edge cavity 18. Intermediate guide vanes 54 are considerably shorter in length in an axial direction than the first, second and third guide vanes and are also staggered axially forwardly in a radially inward direction.

From a review of FIG. 3, a plurality of cooling sections A, B and C are disposed in a radially inward direction along the trailing edge cavity 18. The sections are substantially identical in configuration to one another with each section having a second guide vane, e.g., **40*b* and 40*c*, as well as intermediate guide vane 54*b* and 54*c*, in the illustrated sections B and C. While second guide vane 40*b* in cooling section B is angled, the second guide vane 40*c* in cooling section C is linear and not angled. It will be appreciated that additional cooling sections may be provided as desired. Also, the third guide vane 48 of the first cooling section A also serves as the first guide vane of the second cooling section B. Likewise, the third guide vane 48*b*** of cooling section B serves as the first guide vane for the cooling section C. The flows are essentially identical in each of the cooling sections and will now be described.

With the specific configuration and location of the first and second guide vanes 34 and 40, respectively, the radially inwardly directed flow passing through opening 36 turns from its radially inward direction to an axial direction for flow in a direction toward the trailing edge 30 in the region between the first and second guide vanes. The flow through the bypass opening 38 is to prevent a stagnation area above the first guide vane 34 and to provide a radially inward directional flow. Thus, the majority of the flow passing through opening 36 turns in an axial direction for flow axially toward and for impingement cooling of the trailing edge 30. The convergent flow in the region between the first and second guide vanes 34 and 40, respectively, exhibits a boundary layer character near the walls which remains substantially constant over a large center portion. As the flow approaches the apex of the flow channel, i.e., the trailing edge 30, vortices form and remove heat from the trailing edge. With the vortices formed and turning axially forwardly, the flow is forced in a radially inward direction by the momentum associated with the incoming flow between the intermediate guide vanes and the first and second guide vanes as well as by the bypass flow through opening 38. Consequently, the returning flow moves toward the opening between the second guide vane 40 and third guide vane 48. The majority of the returning flow passes between the second and third guide vanes 40 and 48, respectively, as indicated by the arrow, mixes with bypass flow flowing radially inwardly through the bypass opening 42 and passes through the opening 50 of the third guide vane 48. It will be appreciated that as the flow moves forwardly, the walls of the cavity diverge. Additionally, the cross-sectional area of the opening for the return flow between the second guide vane 40 and the third guide vane 48 correspond substantially identically to the cross-sectional area of the flow opening 50.

It will be appreciated that as the return flow from the opening 50 and the bypass flow from opening 52, that a similar pattern of air flow is provided in the second cooling section B. In this section, the third guide vane 48 of the first cooling section A serves as the first guide vane for the second cooling section B. Thus, a similar pattern as previously described provides for impingement cooling of the trailing edge in the central region of the vane with the flow returning principally to the flow opening **50*b* between the third guide vane 48*b* and the forward end wall 28. Bypass flow passes through opening 52*b*. These two flows flow into the next cooling section C where the flow pattern is essentially repeated. It will be appreciated that in the final cooling section, the third guide vane is omitted and the flow through the flow openings 42*c* and 44*c* of the second guide vane 40*c* pass directly into an outlet 56**.

Figure 4:
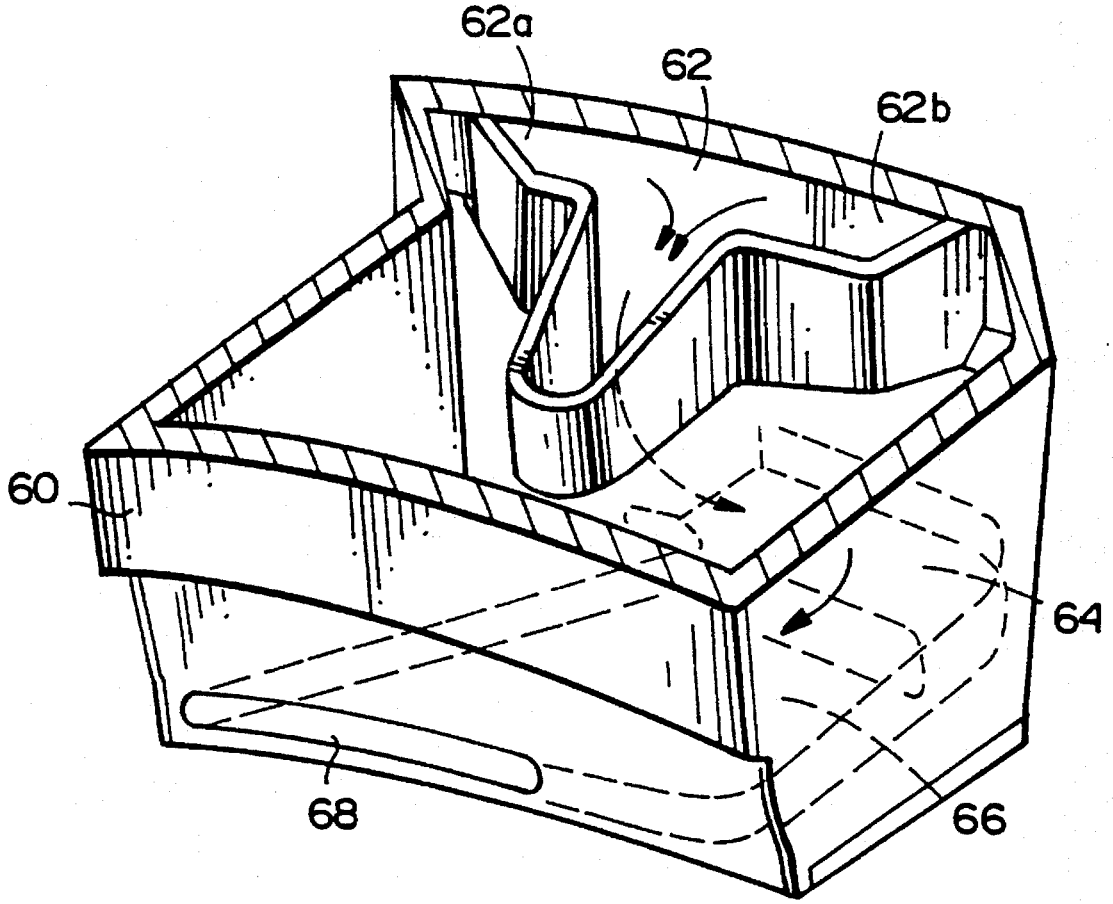
FIG. 4 is a perspective view with parts in cross-section of the diaphragm forming part of the inner ring of the nozzle segment.

The nozzle stage, as will be appreciated, is formed of a plurality of nozzle segments arranged in an annular array thereof. Each segment S may serve one or more vanes and, in the present instances, two vanes per segment are provided. Referring to FIG. 4, there is illustrated a diaphragm 60 forming part of the segment S, the diaphragm 60 having its upper cover wall, not shown, removed for clarity. The pair of vanes 14 coupled to the diaphragm 60 have the trailing edge cavities 18 in communication with opposite sides of an inlet channel 62 through respective outlets 56 of the vanes. That is, the trailing edge cavities 18 lie in communication through outlets 56 with opposite sides **62*a* and 62*b*, respectively, of the chamber 62. The channel 62 extends radially inwardly within the diaphragm 60 and has a series of passageways 64, 66 terminating in an exit opening 68. Preferably, the exit opening 68 and the channels 64, 66 are such that the flow discharges through exit 68** at an angle of about 15° into the seal cavity. The angle is selected such as to minimize the potential for windage losses in the seal cavity by directing the exit flow tangentially in the same direction as the tangential velocity vector of the rotating turbine wheel in the seal cavity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator vane of a nozzle for a turbine comprising:

an airfoil-shaped stator vane body having a plurality of generally radially extending internal cavities for flowing a cooling medium and including a cavity along a trailing edge of said vane body defined in part by opposed vane walls converging toward one another in an axial direction toward said trailing edge;

a radially outer inlet to said trailing edge cavity and a radially inner outlet therefrom for flowing a cooling medium through said trailing edge cavity;

a first guide vane in said cavity between opposed walls thereof and defining radially inwardly directed forward and aft openings between opposite ends of said guide vane and end walls of said trailing edge cavity, respectively;

a second guide vane in said cavity between opposed walls thereof defining radially inwardly directed forward and aft openings between opposite ends of said second guide vane and end walls of said trailing edge cavity, respectively, and lying radially inwardly of said first guide vane to prevent a majority of flow of cooling medium passing through the forward opening of said first guide vane from passing directly radially inwardly past said second guide vane;

a third guide vane in said cavity between opposed walls thereof defining radially inwardly directed forward and aft openings between opposite ends of said third guide vane and end walls of said cavity, respectively, and lying radially inwardly of said second guide vane at a location to prevent the majority of flow of cooling medium passing through the aft opening of said second guide vane from passing directly radially inwardly past said third guide vane; and at least one guide vane radially intermediate said first and second guide vanes for directing flow of cooling medium towards said trailing edge along a convergent path for cooling the trailing edge;

said second and third guide vanes being located for receiving spent cooling medium for mixing with bypass flow through the forward opening of said second guide vane and combined flow through the forward opening of the third guide vane and for flow through the aft opening of said third guide vane;

whereby the cooling medium flow is directed toward said trailing edge for impingement cooling thereof and away from said trailing edge as the cooling medium flows from said inlet to said outlet.

2. A cooling circuit according to claim 1 including a pair of intermediate guide vanes spaced radially from one another and from said first and second guide vanes for directing flow of cooling medium toward said trailing edge along convergent paths for cooling the trailing edge.

3. A cooling circuit according to claim 1 wherein said first guide vane is located relative to the end wall such that a majority of the cooling medium flowing radially inwardly flows through the forward opening of the first guide vane.

4. A cooling circuit according to claim 3 wherein said second guide vane is angled radially outwardly in a direction toward said trailing edge.

5. A cooling circuit according to claim 1 wherein the cross-sectional flow area of an inlet opening between said second guide vane and said third guide vane is substantially equal to the cross-sectional flow area of the forward opening of the third guide vane.

6. A cooling circuit according to claim 1 wherein said intermediate vane is shorter in axial length than any of said first, second and third guide vanes.

7. A cooling circuit according to claim 1 including a pair of intermediate guide vanes spaced radially from one another and from said first and second guide vanes for directing flow of cooling medium toward said trailing edge along convergent paths for cooling the trailing edge, the forward edges of said intermediate guide vanes lying increasingly further away from the trailing edge in a radially inward direction.

8. A cooling circuit according to claim 1 including a diaphragm segment coupled to said vane adjacent a radial inner end thereof, said diaphragm segment having a chamber for receiving spent cooling medium from said trailing edge cavity and a passage for communicating the spent cooling medium axially forwardly into a wheelspace cavity.

9. A cooling circuit according to claim 8 wherein said passage is configured to direct the spent cooling medium in a generally tangential direction.

10. A stator vane of a nozzle for a turbine comprising:

an airfoil-shaped stator vane body having a plurality of generally radially extending internal cavities for flowing a cooling medium and including a cavity along a trailing edge of said vane body defined in part by opposed vane walls converging toward one another in an axial direction toward said trailing edge;

a radially outer inlet to said trailing edge cavity and a radially inner outlet therefrom for flowing a cooling medium through said trailing edge cavity;

a plurality of cooling sections spaced radially one from the other along said trailing edge cavity, a first cooling section including:

(i) a first guide vane in said cavity between opposed walls thereof and defining radially inwardly directed forward and aft openings between opposite ends of said guide vane and end walls of said trailing edge cavity, respectively;

(ii) a second guide vane in said cavity between opposed walls thereof defining radially inwardly directed forward and aft openings between opposite ends of said second guide vane and end walls of said trailing edge cavity, respectively, and lying radially inwardly of said first guide vane to prevent a majority of flow of cooling medium passing through the forward opening of said first guide vane from passing directly radially inwardly past said second guide vane;

(iii) a third guide vane in said cavity between opposed walls thereof defining radially inwardly directed forward and aft openings between opposite ends of said third guide vane and end walls of said cavity, respectively, and lying radially inwardly of said second guide vane at a location to prevent the majority of flow of cooling medium passing through the aft opening of said second guide vane from passing directly radially inwardly past said third guide vane; and (iv) at least one guide vane radially intermediate said first and second guide vanes for directing flow of cooling medium towards said trailing edge along a convergent path for cooling the trailing edge; and (v) said second and third guide vanes being located for receiving spent cooling medium therebetween for mixing with bypass flow through the forward opening of said second guide vane and combined flow through the forward opening of the third guide vane and for flow through the aft opening of said third guide vane;

a second cooling section radially inwardly of said first section including a second guide vane in said cavity between opposed walls thereof defining radially inwardly directed forward and aft openings between opposite ends of said guide vane of said second section and end walls of said trailing edge cavity, respectively, and lying radially inwardly of said third guide vane of said first section to prevent a majority of the combined flow of cooling medium passing through the forward openings of said second and third guide vanes of said first section from passing directly radially inwardly past said second guide vane of the second section;

a third guide vane in said second section of said cavity between opposed walls thereof defining radially inwardly directed forward and aft openings between opposite ends thereof and end walls of said cavity, respectively, and lying radially inwardly of said second guide vane of said second section at a location to prevent the majority of flow of cooling medium passing through the aft opening of said second guide vane of the second section from passing directly radially inwardly past said third guide vane of said second section; and at least one guide vane radially intermediate said first and second guide vanes of said second section for directing flow of cooling medium towards said trailing edge along a convergent path for cooling the trailing edge; and said second and third guide vanes of said second section being located for receiving spent cooling medium for mixing with bypass flow through the forward opening of said second guide vane of said second section and combined flow through the forward opening of the third guide vane of said second section and for flow through the aft opening of said third guide vane of said second section;

whereby the cooling medium flow is repetitively directed toward said trailing edge for impingement cooling thereof and away from said trailing edge as the cooling medium flows from said inlet to said outlet.

11. A cooling circuit according to claim 10 including a pair of intermediate guide vanes in said second section spaced radially from one another and from said first and second guide vanes thereof for directing flow of cooling medium toward said trailing edge along convergent paths for cooling the trailing edge.

12. A cooling circuit according to claim 10 wherein said second guide vane in said second section is angled radially outwardly in a direction toward said trailing edge.

13. A cooling circuit according to claim 10 wherein the cross-sectional flow area of an inlet opening between said second guide vane and said third guide vane in said second section is substantially equal to the cross-sectional flow area of the forward opening of the third guide vane thereof.

14. A cooling circuit according to claim 10 wherein said intermediate vane in said second section is shorter in axial length than any of said first, second and third guide vanes in said second section.

15. A cooling circuit according to claim 10 including a pair of intermediate guide vanes in said second section spaced radially from one another and from said first and second guide vanes thereof for directing flow of cooling medium toward said trailing edge along convergent paths for cooling the trailing edge, the forward edges of said intermediate guide vanes of said second section lying increasingly further away from the trailing edge in a radially inward direction.

16. A stator vane of a nozzle for a turbine comprising:

an airfoil-shaped stator vane body having a plurality of generally radially extending internal cavities for flowing a cooling medium and including a cavity along a trailing edge of said vane body defined in part by opposed vane walls converging toward one another in an axial direction toward said trailing edge;

a radially outer inlet to said trailing edge cavity and a radially inner outlet therefrom for flowing a cooling medium through said trailing edge cavity in a closed circuit and in a generally radially inward direction;

a plurality of cooling sections spaced radially one from the other along said trailing edge cavity, each cooling section including a plurality of vanes, at least one vane in each section disposed to turn a first portion of cooling medium flowing in a generally radially inward direction in a generally axial direction for flow toward said trailing edge and providing impingement cooling thereof, said one vane enabling a second portion of the cooling medium to continue to flow in a generally radially inward direction, at least another vane in each said section for guiding spent impingement cooling medium from said trailing edge in a direction generally away from the trailing edge and toward forward portions of said trailing edge cavity and combining the spent impingement cooling medium with said second cooling medium flow portion enabling the momentum of the second portion of the cooling medium to direct the combined cooling medium into a next radially inward cooling section, whereby cooling medium flow is repeatedly directed toward said trailing edge for impingement cooling thereof and away from said trailing edge as the cooling medium flows radially inwardly from said inlet to said outlet and through said sections.

* * * * *